US012692570B2

(12) United States Patent
Alexandre et al.

(10) Patent No.: US 12,692,570 B2
(45) Date of Patent: Jul. 28, 2026

(54) COLD ROLLED AND HEAT-TREATED STEEL SHEET AND METHOD OF MANUFACTURING THE SAME

(71) Applicant: ArcelorMittal, Luxembourg (LU)

(72) Inventors: Patrice Alexandre, Metz (FR); Magali Bouzat, Norroy-Le-Veneur (FR); Anirban Chakraborty, Chesterton, IN (US); Hassan Ghassemi-Armaki, Schererville, IN (US); Olga Girina, Munster, IN (US); Ronan Jacolot, Landonvillers (FR); Alexey Koltsov, Neufgrange (FR); Aude Nadler, Saint-Avold (FR); Damon Panahi, Chicago, IL (US); Michel Soler, Ars Laquenexy (FR)

(73) Assignee: ArcelorMittal, Luxembourg (LU)

( * ) Notice: Subject to any disclaimer, the term of this patent is extended or adjusted under 35 U.S.C. 154(b) by 1184 days.

(21) Appl. No.: 17/311,808

(22) PCT Filed: Dec. 17, 2019

(86) PCT No.: PCT/IB2019/060889
§ 371 (c)(1),
(2) Date: Jun. 8, 2021

(87) PCT Pub. No.: WO2020/128811
PCT Pub. Date: Jun. 25, 2020

(65) Prior Publication Data

US 2022/0017985 A1 Jan. 20, 2022

(30) Foreign Application Priority Data

Dec. 18, 2018 (WO) ..... PCT/IB2018/060251

(51) Int. Cl.

| | |
|---|---|
| ***C21D 9/46*** | (2006.01) |
| ***C21D 1/18*** | (2006.01) |
| ***C21D 6/00*** | (2006.01) |
| ***C21D 8/02*** | (2026.01) |
| ***C21D 8/0221*** | (2026.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |

(Continued)

(52) U.S. Cl.
CPC ..... *C21D 9/46* (2013.01); *C21D 1/18* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/06* (2013.01); *C22C 38/22* (2013.01); *C22C 38/26* (2013.01); *C22C 38/28* (2013.01); *C22C 38/32* (2013.01); *C22C 38/38* (2013.01); *C23C 2/02* (2013.01); *C23C 2/0224* (2022.08); *C23C 2/024* (2022.08); *C23C 2/29* (2022.08); *C21D 2211/001* (2013.01); *C21D 2211/008* (2013.01)

(58) Field of Classification Search
CPC . C21D 9/46; C21D 1/18; C21D 6/002; C21D 6/005; C21D 6/008; C21D 8/0205; C21D 8/0226; C21D 8/0236; C21D 2211/001; C21D 2211/008; C21D 8/0247; C21D 8/0273; C21D 1/26; C22C 38/58; C22C 38/44; C22C 38/001; C22C 38/002; C22C 38/02; C22C 38/06; C22C 38/22; C22C 38/26; C22C 38/28; C22C 38/32; C22C 38/38; C22C 38/42; C22C 38/46; C22C 38/48; C22C 38/50; C22C 38/54; C23C 2/06; C23C 2/12; C23C 2/40; C23C 2/28
USPC ..... 148/547
See application file for complete search history.

(56) References Cited

U.S. PATENT DOCUMENTS

| | | | |
|---|---|---|---|
| 2011/0146852 A1 | 6/2011 | Matsuda et al. | |
| 2011/0198002 A1* | 8/2011 | Nakagaito ..... | C21D 1/25 148/333 |

(Continued)

FOREIGN PATENT DOCUMENTS

| | | |
|---|---|---|
| CN | 103805840 A | 5/2014 |
| CN | 106661652 A | 5/2017 |

(Continued)

OTHER PUBLICATIONS

See Search Report of PCT/IB2019/060889 dated Feb. 24, 2020.

(Continued)

*Primary Examiner* — Dani Carda
(74) *Attorney, Agent, or Firm* — Davidson Kappel LLC

(57) ABSTRACT

A cold rolled and heat-treated steel sheet having a composition including, by weight percent: C 0.3-0.4%, Mn 2.0-2.6%, Si: 0.8-1.6%, Al 0.01-0.6%, Mo 0.15-0.5%, Cr 0.3-1.0%, Nb≤0.06%, Ti≤0.06%, Ni≤0.8%, S≤0.010%, P≤0.020% and N≤0.008%, the remainder of the composition being iron and unavoidable impurities resulting from the smelting, and having a microstructure consisting of, in surface fraction: between 15% and 30% of retained austenite, said retained austenite having a carbon content of at least 0.7%, between 70% and 85% of tempered martensite, at most 5% of fresh martensite and at most 5% of bainite. It also deals with a manufacturing method thereof.

15 Claims, No Drawings

(51) Int. Cl.

| | |
|---|---|
| ***C22C 38/38*** | (2006.01) |
| ***C23C 2/02*** | (2006.01) |
| ***C23C 2/28*** | (2006.01) |

(56) References Cited

U.S. PATENT DOCUMENTS

| | | | | |
|---|---|---|---|---|
| 2013/0133786 | A1 | 5/2013 | Matsuda et al. | |
| 2014/0322559 | A1* | 10/2014 | Becker | C22C 38/18 148/333 |
| 2014/0377584 | A1* | 12/2014 | Hasegawa | C23C 2/29 148/533 |
| 2016/0108492 | A1 | 4/2016 | Zhong et al. | |
| 2017/0137910 | A1 | 5/2017 | Girina et al. | |
| 2017/0159143 | A1 | 6/2017 | Foejer et al. | |
| 2019/0218652 | A1 | 7/2019 | Haga et al. | |
| 2019/0256945 | A1 | 8/2019 | Zhou et al. | |

FOREIGN PATENT DOCUMENTS

| | | | | |
|---|---|---|---|---|
| EP | 2683839 | B1 | 4/2015 | |
| JP | 2004091924 | A | 3/2004 | |
| JP | 2012031462 | A | 2/2012 | |
| JP | 2014518945 | A | 8/2014 | |
| JP | 2015151576 | A | 8/2015 | |
| JP | 2017053001 | A1 | 3/2017 | |
| JP | 2020509204 | A | 3/2020 | |
| KR | 20160080818 | A | 7/2016 | |
| WO | WO2009099079 | | 8/2009 | |
| WO | WO2010029983 | | 3/2010 | |
| WO | WO-2012120020 | A1 * | 9/2012 | C21D 8/02 |
| WO | WO-2017115107 | A1 * | 7/2017 | B32B 15/01 |
| WO | WO2017150117 | A1 | 9/2017 | |
| WO | WO2018073919 | | 4/2018 | |
| WO | WO 2018/076965 | A1 | 5/2018 | |

OTHER PUBLICATIONS

De Moor E et al, "Quench and Partitioning response of a Mo-alloyed CMnSi steel", New Developments on Metallurgy and Applications of High Strength Steels :Buenos Aires 2008 ; International Conference, May 26-28, Hilton Hotel, Buenos Aires, Argen,, (May 26, 2008), vol. 2, ISBN 978-0-87339-729-2, pp. 721-730, XP009182284 [A] 1-17 * abstract *.

* cited by examiner

COLD ROLLED AND HEAT-TREATED STEEL SHEET AND METHOD OF MANUFACTURING THE SAME

The present invention relates to a high strength steel sheet having high ductility and formability and to a method to obtain such steel sheet.

BACKGROUND

To manufacture various items such as parts of body structural members and body panels for automotive vehicles, it is known to use sheets made of DP (Dual Phase) steels or TRIP (Transformation Induced Plasticity) steels.

To reduce the weight of the automotive in order to improve their fuel efficiency in view of the global environmental conservation, it is desirable to have sheets having improved yield and tensile strengths. But such sheets must also have a good ductility and a good formability and more specifically a good stretch flangeability.

In addition to these mechanical requirements, such steel sheets have to show a good resistance to liquid metal embrittlement (LME). Zinc or Zinc-alloy coated steel sheets are very effective for corrosion resistance and are thus widely used in the automotive industry. However, it has been experienced that arc or resistance welding of certain steels can cause the appearance of particular cracks due to a phenomenon called Liquid Metal Embrittlement ("LME") or Liquid Metal Assisted Cracking ("LMAC"). This phenomenon is characterized by the penetration of liquid Zn along the grain boundaries of underlying steel substrate, under applied stresses or internal stresses resulting from restraint, thermal dilatation or phases transformations. It is known that adding elements like carbon or silicon are detrimental for LME.

The automotive industry usually assesses such resistance by limiting the upper value of a so-called LME index calculated according to the following equation:

$$\text{LME index} = \%\,C + \%\,Si/4,$$

wherein % C and % Si stands respectively for the weight percentages of carbon and silicon in the steel.

The publication WO2010029983 describes a method to obtain a high strength steel sheet with a tensile strength higher than 980 MPa, and even higher than 1180 MPa. By using high amount of silicon in steel composition of the invention with tensile strength higher than 1470 MPa, the liquid metal embrittlement resistance of the steel will however be decreased.

In the publication WO2018073919, a high strength galvanized and galvannealed steel sheet is described. A high amount of manganese and silicon is necessary to obtain a tensile strength higher than 1470 MPa. A high level of manganese may create segregation issues detrimental for ductility and a high level of silicon will decrease liquid metal embrittlement resistance.

In the publication WO2009099079, a high strength galvanized steel sheet is produced with a tensile strength higher than 1200 MPa, a total elongation higher than 13% and a hole expansion ratio higher than 50%. The microstructure of this steel sheet contains 0% to 10% of ferrite, 0% to 10% of martensite, 60% to 95% of tempered martensite and contains 5% to 20% of retained austenite. To increase the value of tensile strength to more than 1470 MPa, the microstructure of this steel sheet comprises high amount of tempered martensite, and very low amount of retained austenite, which highly reduce the ductility of the steel sheet.

SUMMARY OF THE INVENTION

It is an object of the present invention to provide a steel sheet reaching a yield strength of at least 1100 MPa, a tensile strength of at least 1470 MPa, a total elongation of at least 13%, a hole expansion ratio of at least 15% and a LME index of less than 0.70.

The present invention provides a cold-rolled and heat-treated steel sheet, made of a steel having a composition comprising, by weight percent:

C: 0.3-0.4%
Mn: 2.0-2.6%
Si: 0.8-1.6%
Al: 0.01-0.6%
Mo: 0.15-0.5%
Cr: 0.3-1.0%
Nb≤0.06%
Ti≤0.06%
Ni≤0.8%
S≤0.010%
P≤0.020%
N≤0.008%
Cu≤0.03% and comprising optionally one or more of the following elements, in weight percentage:

B: 0.0003-0.005%
V≤0.2% the remainder of the composition being iron and unavoidable impurities resulting from the smelting, said steel sheet having a microstructure consisting of, in surface fraction:

between 15% and 30% of retained austenite, said retained austenite having a carbon content of at least 0.7%
between 70% and 85% of tempered martensite and
at most 5% of fresh martensite and
at most 5% of bainite.

The present invention also provides a method for manufacturing a cold-rolled and heat-treated steel sheet, comprising the following successive steps:

casting a steel to obtain a slab, said steel having a composition as described above,
reheating the slab at a temperature $T_{reheat}$ comprised between 1150° C. and 1300° C.,
hot rolling the reheated slab at a temperature higher than Ar3 to obtain a hot rolled steel sheet,
coiling the hot rolled steel sheet at a coiling temperature $T_{coil}$ comprised between 200° C. and 700° C.,
optionally pickling said hot rolled steel sheet,
optionally annealing the hot rolled steel sheet, to obtain a hot-rolled and annealed steel sheet,
optionally pickling said hot-rolled and annealed steel sheet,
cold rolling the hot-rolled and annealed steel sheet to obtain a cold rolled steel sheet,
reheating the cold-rolled steel sheet to an annealing temperature between Ac3 and Ac3+100° C. and maintaining the cold-rolled steel sheet at said annealing temperature for a holding time comprised between 30 s and 600 s, to obtain, upon annealing, a fully austenitic structure,
quenching the cold-rolled steel sheet at a cooling rate comprised between 0.1° C./s and 200° C./s, to a quenching temperature Tq comprised between (Ms-140° C.) and (Ms-75° C.) and optionally maintaining it at Tq for a holding time comprised between 1 and 200 s, reheating the cold-rolled steel sheet to a partitioning temperature comprised between 350° C. and 500° C., and maintaining the cold-rolled steel sheet at said partitioning temperature for a partitioning time comprised between 30 s and 2000 s, cooling the cold-rolled steel and heat-treated sheet to the room temperature.

DETAILED DESCRIPTION

The invention will now be described in detail and illustrated by examples without introducing limitations.

Hereinafter, Ac3 designates the transformation temperature above which austenite is completely stable, Ar3 designates the temperature until which the microstructure remains fully austenitic upon cooling, Ms designates the martensite start temperature, i.e. the temperature at which the austenite begins to transform into martensite upon cooling.

All compositional percentages are given in weight percent (wt. %), unless indicated otherwise.

The composition of the steel according to the invention comprises, by weight percent:

0.3%≤C≤0.4% for ensuring a satisfactory strength and improving the stability of the retained austenite which is necessary to obtain a sufficient elongation. If the carbon content is above 0.4%, the hot rolled sheet is too hard to cold roll and the weldability is insufficient. If the carbon content is below 0.3%, the tensile strength and total elongation will not reach the targeted values.

2.0%≤Mn≤2.6% for ensuring a satisfactory strength and achieving stabilization of at least part of the austenite, to obtain a sufficient elongation. Below 2.0%, the final structure comprises an insufficient retained austenite fraction, so that the desired combination of ductility and strength is not achieved. The maximum is defined to avoid having segregation issues which are detrimental for stretch formability and to limit weldability issues.

0.8%≤Si≤1.6% as silicon delays the precipitation of cementite. Therefore, a silicon addition of at least 0.8% helps to stabilize a sufficient amount of retained austenite. Silicon further provides solid solution strengthening and retards the formation of carbides during carbon redistribution from martensite to austenite resulting from an immediate reheating and holding step performed after a partial martensitic transformation. At a too high content, silicon oxides form at the surface, which impairs the coatability of the steel. Moreover, silicon is detrimental for the liquid metal embrittlement resistance. Therefore, the Si content is less than or equal to 1.6%. In a preferred embodiment, silicon content is below 1.5% to further enhance liquid metal embrittlement resistance. In an other preferred embodiment, silicon content is below 1.4%, and in an other preferred embodiment, silicon content is below 1.3%.

0.01%≤Al≤0.6% as aluminum is a very effective element for deoxidizing the steel in the liquid phase during elaboration. Moreover, aluminium retards the formation of carbides during carbon redistribution from martensite to austenite resulting from an immediate reheating and holding step performed after a partial martensitic transformation. The aluminium content is not higher than 0.6% to avoid the occurrence of inclusions, to avoid oxidation problems and to limit the increase of Ac3 temperature which makes it harder to create fully austenitic structures. In a preferred embodiment, aluminium content is comprised between, 0.2% and 0.5%.

In a preferred embodiment, the cumulated amount of silicon and aluminium Si+Al is equal to or above 1.6%.

0.15%≤Mo≤0.5%. Molybdenum increases the hardenability, stabilizes the retained austenite thus reducing austenite decomposition during partitioning. Furthermore, molybdenum, together with chromium, helps inhibiting grain boundary oxidation at the surface of the hot rolled steel sheet during coiling that must be removed before cold rolling. Above 0.5%, the addition of molybdenum is costly and ineffective in view of the properties which are sought after. In a preferred embodiment, the molybdenum content is between 0.20% and 0.40%.

0.3%≤Cr≤1.0%. Chromium increases the hardenability, and delays martensite tempering. Chromium, together with molybdenum, helps inhibiting grain boundary oxidation at the surface of the hot rolled steel sheet after coiling that must be removed before cold rolling. A maximum of 1.0% of chromium is allowed, above a saturation effect is noted, and adding chromium is both useless and expensive. Higher chromium causes surface cleaning issues during pickling process and as a result, affects coatability of the steel. In a preferred embodiment, the chromium content is between 0.6% and 0.8%.

Nb≤0.06% can be added to refine the austenite grains during hot-rolling and to provide precipitation strengthening. Preferably, the minimum amount of niobium added is 0.0010%. Above 0.06% of addition, yield strength, elongation and hole expansion ratio are not secured at the desired level. Preferably, the maximum amount of niobium added is 0.04%.

Ti≤0.06% can be added to provide precipitation strengthening. Preferably, the minimum amount of titanium added is 0.0010%. However, when its amount is above or equal to 0.06%, yield strength, elongation and hole expansion ratio are not secured at the desired level. Preferably, the maximum amount of titanium added is 0.04%.

Preferably, the cumulated amount of niobium and titanium Nb+Ti is higher than 0.01%.

Ni≤0.8% Nickel could be a substitute element for chromium or molybdenum and can be added to stabilize retained austenite. Preferably, the minimum amount of nickel added is 0.0010%.

Some elements can optionally be added to the composition of the steel according to the invention:

V≤0.2% can be added to provide precipitation strengthening. Preferably, the minimum amount of vanadium added is 0.0010%. However, when its amount is above or equal to 0.2%, yield strength, elongation and hole expansion ratio are not secured at the desired level.

B: 0.0003-0.005% can be added in order to increase the quenchability of the steel.

The remainder of the composition of the steel is iron and impurities resulting from the smelting. In this respect, Cu, S, P and N at least are considered as residual elements which are unavoidable impurities. Therefore, their contents are less than 0.03% for Cu, 0.010% for S, 0.020% for P and 0.008% for N.

Preferably, the composition of the steel is such that the steel has a carbon equivalent Ceq lower or equal to 0.55%, the carbon equivalent being defined as Ceq=% C+% Mn/20+% Si/28+2*% P The microstructure of the cold-rolled and heat-treated steel sheet according to the invention will be now described.

The cold-rolled and heat-treated steel sheet has a structure consisting of, in surface fraction:

between 15% and 30% of retained austenite, said retained austenite having a carbon content of at least 0.7% between 70% and 85% of tempered martensite and at most 5% of fresh martensite and at most 5% of bainite.

The surface fractions are determined through the following method: a specimen is cut from the cold-rolled and heat-treated, polished and etched with a reagent known per se, to reveal the microstructure. The section is afterwards examined through optical or scanning electron microscope, for example with a Scanning Electron Microscope with a Field Emission Gun ("FEG-SEM") at a magnification greater than 5000×, coupled to an Electron Backscatter Diffraction ("EBSD") device and to a Transmission Electron Microscopy (TEM).

The determination of the surface fraction of each constituent are performed with image analysis through a method known per se. The retained austenite fraction is for example determined by X-ray diffraction (XRD).

The microstructure of the cold-rolled and heat-treated steel sheet includes at least 15% of austenite which is, at room temperature, retained austenite. When present in surface fraction of at least 15%, retained austenite contributes to increasing ductility. Above 30%, the required level of hole expansion ratio HER according to ISO 16630:2009 is lower than 15%, as the carbon content in austenite would be too low to stabilize austenite.

The carbon content of the retained austenite is above 0.7% to ensure that the steel sheet according to the invention can reach the hole expansion ratio and strength and elongation targeted.

The microstructure of the cold-rolled and heat-treated steel sheet includes tempered martensite in an amount of 70 to 85% in surface fraction.

Tempered martensite is the martensite formed upon cooling after the annealing then tempered during the partitioning step.

The microstructure of the cold-rolled and heat-treated steel sheet includes at most 5% of fresh martensite and at most 5% of bainite.

Fresh martensite is the martensite that can be formed upon cooling after the partitioning step.

In a preferred embodiment, the cold-rolled and heat-treated steel sheet according to the invention is such that the surface fraction of fresh martensite is below 2% and that the surface fraction of bainite is below 2%.

In another embodiment, the cold-rolled and heat-treated steel sheet according to the invention is such that no fresh martensite no bainite is contained.

The microstructure of the cold-rolled and heat-treated steel sheet according to the invention contains no ferrite and no pearlite.

The steel sheet according to the invention can be produced by any appropriate manufacturing method and the man skilled in the art can define one. It is however preferred to use the method according to the invention comprising the following steps:

Hot rolled sheet having a thickness between, for example, 1.8 to 6 mm, can be produced by casting a steel having a composition as mentioned above so as to obtain a slab, reheating the slab at a temperature $T_{reheat}$ comprised between 1150° C. and 1300° C., and hot rolling the reheated slab, the final rolling temperature being higher than Ar3, to obtain a hot rolled steel.

The final rolling temperature is preferably of at most 1000° C., in order to avoid coarsening of the austenitic grains.

The hot-rolled steel is then cooled, at a cooling rate for example comprised between 1° C./s and 120° C./s, and coiled at a temperature $T_{coil}$ comprised between 200° C. and 700° C. In a preferred embodiment, $T_{coil}$ is comprised between 450° C. and 650° C.

The hot rolled steel sheet after coiling comprises a grain boundary oxidation layer having a maximum thickness of 5 μm.

After the coiling, the sheet can be pickled.

The hot-rolled steel sheet can then be annealed, in order to improve the cold-rollability and the toughness of the hot-rolled steel sheet, and in order to provide a hot-rolled and annealed steel sheet which is suitable for producing a cold-rolled and heat-treated steel sheet having high mechanical properties, in particular a high strength and a high ductility.

In a preferred embodiment, the annealing performed on the hot-rolled steel sheet is a batch annealing, performed at a temperature comprised between 500 and 800° C., during 1000 s to 108000 s.

The hot-rolled and annealed steel sheet is then optionally pickled.

The hot-rolled and annealed steel sheet is then cold-rolled to obtain a cold rolled steel sheet having a thickness that can be, for example, between 0.7 mm and 3 mm, or even better in the range of 0.8 mm to 2 mm.

The cold-rolling reduction ratio is preferably comprised between 20% and 80%. Below 20%, the recrystallization during subsequent heat-treatment is not favored, which may impair the ductility of the cold-rolled and heat-treated steel sheet. Above 80%, there is a risk of edge cracking during cold-rolling.

The cold-rolled steel sheet is then heat treated on a continuous annealing line.

The heat treatment comprises the steps of:

reheating the cold-rolled steel sheet to an annealing temperature between Ac3 and Ac3+100° C. and maintaining the cold-rolled steel sheet at said annealing temperature for a holding time comprised between 30 s and 600 s, to obtain, upon annealing, a fully austenitic structure, The reheating rate to the annealing temperature is preferably comprised between 1° C./s and 200° C./s.

quenching the cold-rolled steel sheet at a cooling rate preferably comprised between 0.1° C./s and 200° C./s, to a quenching temperature Tq comprised between (Ms-140° C.) and (Ms-75° C.), and preferably between 150° C. and 215° C., and maintaining it at said quenching temperature for a holding time comprised between 1 and 200 s.

The cooling rate is chosen to avoid the formation of pearlite upon cooling.

During this quenching step, the austenite partly transforms into martensite.

If the quenching temperature is lower than (Ms-140° C.), the fraction of tempered martensite in the final structure is too high, leading to a final austenite fraction below 15%, which is detrimental for the total elongation of the steel. Besides, if the quenching temperature is higher than (Ms-75° C.), the desired hole expansion ratio is not achieved.

optionally holding the quenched sheet at the quenching temperature for a holding time comprised between 1 s and 200 s, preferably between 3 s and 30 s, so as to avoid the formation of epsilon carbides in martensite, that would result in a decrease in the elongation of the steel.

reheating the cold-rolled steel sheet to a partitioning temperature comprised between 350° C. and 500° C., and maintaining the cold-rolled steel sheet at said partitioning temperature for a partitioning time comprised between 30 s and 2000 s, and more preferably between 30 s and 800 s.

optionally hot-dip coating the sheet. Any kind of coatings can be used and in particular, zinc or zinc alloys, like zinc-nickel, zinc-magnesium or zinc-magnesium-aluminum alloys, aluminum or aluminum alloys, for example aluminum-silicon.

immediately after the partitioning step, or immediately after the hot-dip coating step, if performed, cooling the cold-rolled steel sheet to the room temperature, to obtain a cold-rolled and heat-treated steel sheet. The cooling rate is preferably higher than 1° C./s, for example comprised between 2° C./s and 20° C./s.

optionally, after cooling down to the room temperature, if the hot-dip coating step has not been performed, the sheet can be coated by electrochemical methods, for example electro-galvanizing, or through any vacuum coating process, like PVD or Jet Vapor Deposition. Any kind of coatings can be used and in particular, zinc or zinc alloys, like zinc-nickel, zinc-magnesium or zinc-magnesium-aluminum alloys. Optionally, after coating by electro-galvanizing, the sheet may be subjected to degassing.

EXAMPLES 2 grades, which compositions are gathered in table 1, were cast in semi-products and processed into steel sheets following the process parameters gathered in table 2.

TABLE 1

| Compositions | | | | | | | | | | | | | | | | |
|---|---|---|---|---|---|---|---|---|---|---|---|---|---|---|---|---|
| Steel | C | Mn | Si | Al | Mo | Cr | Ti | Nb | B | S | P | N | Ar3 | Ac3 | Ms | LME index |
| A | 0.36 | 2.3 | 1.21 | 0.44 | 0.25 | 0.8 | 0.02 | 0.03 | 0.0005 | 0.002 | 0.013 | 0.004 | 683 | 839 | 292 | 0.66 |
| B | 0.29 | 2.3 | 0.81 | 0.60 | 0.002 | 1.0 | 0.002 | 0.002 | 0.0007 | 0.002 | 0.010 | 0.003 | 681 | 875 | 335 | 0.50 |

Steel A is according to the invention.
Underlines values: not corresponding to the invention.

The tested compositions are gathered in the following table wherein the element contents are expressed in weight percent. No amount of vanadium was added.

For a given steel, one skilled in the art knows how to determine Ar3, Ac3 and Ms through dilatometry tests and metallography analysis.

TABLE 2

| Process parameters | | | | | | | | | |
|---|---|---|---|---|---|---|---|---|---|
| | | Hot rolled sheet | | | Cold rolled sheet | | | | |
| Trial | Steel | Tcoil (° C.) | T annealing (° C.) | t of annealing (h) | T annealing (° C.) | t of annealing (s) | Tq (° C.) | T partitioning (° C.) | t of partitioning (s) |
| 1* | A | 450 | 650 | 8 | 900 | 160 | 180 | 400 | 270 |
| 2* | A | 450 | 650 | 8 | 900 | 160 | 200 | 400 | 270 |
| 3* | A | 550 | 650 | 8 | 900 | 160 | 160 | 400 | 270 |
| 4 | A | 450 | 650 | 8 | 900 | 160 | 225 | 400 | 270 |
| 5 | A | 750 | — | — | — | — | — | — | — |
| 6 | B | 650 | — | — | — | — | — | — | — |
| 7* | A | 650 | — | — | 900 | 160 | 180 | 400 | 270 |

*trials according to the invention.

Underlines values: not corresponding to the invention

Steel semi-products, as cast, were reheated at 1250° C., hot rolled above Ar3 and then coiled, pickled, optionally annealed during 8 h, pickled and cold rolled with a 50% reduction rate. They were then reheated, quenched and partitioned before being cooled to room temperature. In trials 5 and 6 steels are only hot rolled and coiled. The following specific conditions were applied:

Some samples of hot rolled sheet after coiling were analyzed to assess the possible presence of a grain boundary oxidation layer and the corresponding results are gathered in table 3.

Some samples of cold rolled and heat-treated sheets were then analyzed and the corresponding microstructure elements and mechanical properties were respectively gathered in table 4 and 5.

TABLE 3

Grain boundary oxidation of the hot rolled steel sheet

| Trial | GBO layer | Thickness (μm) |
|---|---|---|
| 1* | No | 0 |
| 2* | No | 0 |
| 3* | Yes | 1 |
| 5 | Yes | 7 |
| 6 | Yes | 8 |
| 7* | Yes | 1 |

*trials according to the invention.

Grain boundary oxidation is intergranular oxidation which is characterized by discontinuities on the surface of the coiled sheet. In the iron layer on the steel surface, oxides are dispersed between the grains. The grain boundaries of the final microstructure naturally constitute diffusion short-circuits for elements that are more oxidizable than iron compared to a uniform diffusion in the matrix. The result is more marked oxidation and deeper oxidation at the level of the grain boundaries.

The presence of a grain boundary oxidation layer (GBO) on the hot rolled steel sheet after coiling was determined:

Trials 1 to 3 and 7 show good control of the GBO growth and even full inhibition for trials 1 and 2, due to the combination of the steel composition and the coiling temperature range. Trial 5 exhibit poor results due to the high coiling temperature whereas trial 6 does not show good results due to the absence of molybdenum in the grade.

TABLE 4

Microstructure of the cold rolled and annealed steel sheet

| Trial | y (%) | C in y (%) | TM (%) | FM (%) | B (%) | F (%) |
|---|---|---|---|---|---|---|
| 1* | 20 | 0.79 | 80 | 0 | 0 | 0 |
| 2* | 24 | 0.73 | 74 | 2 | 0 | 0 |
| 3* | 16 | 0.79 | 84 | 0 | 0 | 0 |
| 4 | 28 | 0.72 | 64 | 6 | 2 | 0 |
| 7* | 21 | 0.70 | 79 | 0 | 0 | 0 |

*trials according to the invention/Underlined values: not corresponding to the invention
y: stands for residual austenite surface fraction
C in y: stands for the carbon content of the austenite phase
TM: stands for tempered martensite surface fraction
FM: stands for fresh martensite surface fraction
B: stands for bainite surface fraction
F: stands for ferrite surface fraction The phase percentages of the microstructures of the obtained cold rolled steel sheet were determined:

TABLE 5

Mechanical properties of the cold rolled and annealed steel sheet

| Trial | YS (MPa) | TS (MPa) | TE (%) | HER (%) |
|---|---|---|---|---|
| 1* | 1210 | 1524 | 16 | 20 |
| 2* | 1248 | 1517 | 15 | 16 |
| 3* | 1340 | 1551 | 14 | 21 |
| 4 | 1050 | 1550 | 14 | 5 |
| 7* | 1248 | 1527 | 16 | 19 |

*trials according to the invention
Underlined values: do not match mechanical properties.

Mechanical properties of the tested samples were determined and gathered in the following table:

The yield strength YS, the tensile strength TS and the uniform elongation TE are measured according to ISO standard ISO 6892-1, published in October 2009. The hole expansion ratio HER is measured according to ISO standard 16630:2009. Due to differences in the methods of measure, the values of the hole expansion ratio HER according to the ISO standard 16630:2009 are very different and not comparable to the values of the hole expansion ratio A according to the JFS T 1001 (Japan Iron and Steel Federation standard).

The examples show that the steel sheets according to the invention, namely examples 1-3 and 7 are the only one to show all the targeted properties thanks to their specific composition and microstructures. The cold rolled and annealed steel sheet of the example 4 has a chemical composition corresponding to the invention, and is quenched at a temperature Tq equal to 225° C., which creates more fresh martensite leading to a low level of hole expansion ratio.

What is claimed is:

1. A cold-rolled and heat-treated steel sheet, made of a steel having a composition comprising, by weight percent:

C: 0.3-0.4%
Mn: 2.0-2.6%
0.8≤Si<1.5%
Al: 0.01-0.6%
Mo: 0.15-0.5%
Cr: 0.3-1.0%
0.0010%≤Nb≤0.06%
0.0010%≤Ti≤0.06%
Ni≤0.8%
S≤0.010%
P≤0.020%
N≤0.008%
Cu≤0.03%
and optionally one or more of the following elements, in weight percentage:
B: 0.0003-0.005%
V≤0.2%
a remainder of the composition being iron and unavoidable impurities resulting from processing,
the steel sheet having a microstructure consisting of, in surface fraction:
between 15% and 30% of retained austenite, said retained austenite having a carbon content of at least 0.7%;
between 70% and 85% of tempered martensite;
at most 5% of fresh martensite; and
at most 5% of bainite;

wherein the cold-rolled and heat-treated steel sheet has a yield strength YS of at least 1100 MPa, a tensile strength TS of at least 1470 MPa, a total elongation TE of at least 13%, a hole expansion ratio HER of at least 15% and an LME index of less than 0.70.

2. The cold-rolled and heat-treated steel sheet as recited in claim 1 wherein the chromium content is between 0.6% and 0.8%.

3. The cold-rolled and heat-treated steel sheet as recited in claim 1 wherein the silicon content is below 1.4%.

4. The cold-rolled and heat-treated steel sheet as recited in claim 3 wherein the silicon content is below 1.3%.

5. The cold-rolled and heat-treated steel sheet as recited in claim 1 wherein the cumulated amount of silicon and aluminum is equal to or above 1.6%.

6. The cold-rolled and heat-treated steel sheet as recited in claim 1 wherein the aluminum content is between 0.2% and 0.5%.

7. The cold-rolled and heat-treated steel sheet as recited in claim 1 wherein the molybdenum content is between 0.20% and 0.40%.

8. The cold-rolled and heat-treated steel sheet as recited in claim 1 wherein the microstructure includes at most 2% of fresh martensite.

9. The cold-rolled and heat-treated steel sheet as recited in claim 1 wherein the microstructure includes at most 2% of bainite.

10. The cold-rolled and heat-treated steel sheet as recited in claim 1 wherein the microstructure includes no bainite and no fresh martensite.

11. The cold-rolled and heat-treated steel sheet as recited in claim 1 wherein the cold-rolled and heat-treated steel sheet is coated with Zn or a Zn alloy or with Al or an Al alloy.

12. A method for manufacturing a cold-rolled and heat-treated steel sheet, comprising the following successive steps:

casting a steel to obtain a slab, said steel having a composition comprising, by weight percent:

C: 0.3-0.4%
Mn: 2.0-2.6%
0.8≤Si≤1.5%
Al: 0.01-0.6%
Mo: 0.15-0.5%
Cr: 0.3-1.0%
0.0010%≤Nb≤0.06%
0.0010%≤Ti≤0.06%
Ni≤0.8%
S≤0.010%
P≤0.020%
N≤0.008%
Cu≤0.03% and optionally one or more of the following elements, in weight percentage:

B: 0.0003-0.005%
V≤0.2% a remainder of the composition being iron and unavoidable impurities resulting from processing;

reheating the slab at a temperature $T_{reheat}$ comprised between 1150° C. and 1300° C., hot rolling the reheated slab at a temperature higher than Ar3 to obtain a hot rolled steel sheet;

coiling the hot rolled steel sheet at a coiling temperature $T_{coil}$ between 200° C. and 700° C.;

optionally pickling said hot rolled steel sheet;

optionally annealing the hot rolled steel sheet, to obtain a hot-rolled and annealed steel sheet;

optionally pickling said hot-rolled and annealed steel sheet;

cold rolling the hot-rolled and annealed steel sheet to obtain a cold rolled steel sheet;

reheating the cold-rolled steel sheet to an annealing temperature between Ac3 and Ac3+100° C. and maintaining the cold-rolled steel sheet at the annealing temperature for a holding time between 30 s and 600 s, to obtain, upon annealing, a fully austenitic structure;

quenching the cold-rolled steel sheet at a cooling rate comprised between 0.1° C./s and 200° C./s, to a quenching temperature Tq between (Ms-140° C.) and (Ms-75° C.) and optionally maintaining it at Tq for a holding time between 1 and 200 s;

reheating the cold-rolled steel sheet to a partitioning temperature between 350° C. and 500° C., and maintaining the cold-rolled steel sheet at the partitioning temperature for a partitioning time between 30 s and 2000 s; and cooling the cold-rolled steel and heat-treated sheet to room temperature to obtain the cold-rolled steel and heat-treated sheet as recited in claim 1.

13. The method as recited in claim 12 wherein the coiling temperature $T_{coil}$ is between 450° C. and 650° C.

14. The method as recited in claim 12 wherein the hot rolled steel sheet after coiling comprises a grain boundary oxidation layer having a maximum thickness of 5 μm.

15. The method as recited in claim 12 wherein the hot rolled steel sheet is annealed at a temperature between 500 and 800° C., during 1000 s to 108000 s.

* * * * *